US009203196B2

(12) United States Patent
Hirakawa

(10) Patent No.: US 9,203,196 B2
(45) Date of Patent: Dec. 1, 2015

(54) ELECTRICAL COAXIAL CONNECTOR

(71) Applicant: DAI-ICHI SEIKO CO., LTD., Kyoto (JP)

(72) Inventor: Takeshi Hirakawa, Tokyo (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 14/460,242

(22) Filed: Aug. 14, 2014

(65) Prior Publication Data

US 2015/0072556 A1 Mar. 12, 2015

(30) Foreign Application Priority Data

Sep. 6, 2013 (JP) ..... 2013-185535

(51) Int. Cl.
*H01R 24/50* (2011.01)
*H01R 103/00* (2006.01)

(52) U.S. Cl.
CPC ..... *H01R 24/50* (2013.01); *H01R 2103/00* (2013.01)

(58) Field of Classification Search
CPC ..... H01R 9/0512; H01R 9/05; H01R 13/052
USPC ..... 439/578, 20, 63, 582, 581, 579, 851
See application file for complete search history.

(56) References Cited

U.S. PATENT DOCUMENTS 5,628,656 A * 5/1997 Macioce et al. ..... 439/851
7,651,335 B2 * 1/2010 Chen ..... 439/63
7,993,144 B2 * 8/2011 Hu et al. ..... 439/63
8,047,871 B2 * 11/2011 Kohnishi et al. ..... 439/582
8,298,007 B2 * 10/2012 Taguchi ..... 439/578
8,419,463 B2 * 4/2013 Taguchi ..... 439/449
8,636,522 B2 * 1/2014 Sykes et al. ..... 439/63
8,648,954 B2 * 2/2014 Kobayashi et al. ..... 348/333.11
2010/0062640 A1 * 3/2010 Maruyama et al. ..... 439/582
2010/0081320 A1 * 4/2010 Maruyama et al. ..... 439/578
2011/0028033 A1 * 2/2011 Sato et al. ..... 439/578
2012/0214339 A1 * 8/2012 Stein ..... 439/578
2013/0012062 A1 * 1/2013 Nugent ..... 439/578

FOREIGN PATENT DOCUMENTS

JP 2009-104836 A 5/2009
JP 2012-028210 A 2/2012
JP 2013-098122 A 5/2013

(Continued)

*Primary Examiner* — Tulsidas C Patel
*Assistant Examiner* — Peter G Leigh
(74) *Attorney, Agent, or Firm* — Studebaker & Brackett PC

(57) ABSTRACT

An electrical coaxial connector comprising a signal-joining contacting conductor having a body portion to be connected with a signal joining conductor of a mating coaxial connector, a grounding contacting conductor having an annular portion placed around the body portion of the signal joining contacting conductor to be connected with a grounding conductor of the mating coaxial connector, and an insulating base member for supporting the signal-joining contacting conductor and the grounding contacting conductor to be isolated from each other, wherein the body portion of the signal-joining contacting conductor is formed into a cylindrical shape with a slit extending to surround an imaginary central axis of the cylindrical shape of the body portion and provided with a base part and an engaging part opposite to each other with the slit between and connected with each other by a connecting part of the body portion at which the slit is not formed.

12 Claims, 10 Drawing Sheets

(56) References Cited

FOREIGN PATENT DOCUMENTS

| | | | |
|---|---|---|---|
| JP | 2013-118121 | A | 6/2013 |
| WO | 2010/087202 | A1 | 8/2010 |
| WO | 2011/013747 | A1 | 2/2011 |
| WO | 2013/046829 | A1 | 4/2013 |

* cited by examiner

ELECTRICAL COAXIAL CONNECTOR

BACKGROUND OF THE INVENTION

1. Field of the Invention

The present invention relates generally to an electrical coaxial connector, and more particularly to an improvement in an electrical coaxial connector to be mounted on a circuit board for transmitting signals from the circuit board to the outside thereof or to the circuit board from the outside thereof under a condition of electro-magnetic shield.

2. Description of the Prior Art Including Information Disclosed Under 37 CFR 1.97 and 37 CFR 1.98

A high-frequency signal flowing through conductors arranged on a circuit board is mostly dealt with as a signal which requires to be put in a condition of electro-magnetic shield so as to be inactive to leak out from the conductors or to prevent noises from mixing into the signal from the outside when the high-frequency signal is transmitted from the circuit board to the outside thereof or to the circuit board from the outside thereof. For transmitting the high-frequency signal from a specific circuit board to the outside thereof, for example, to another circuit board, or to the specific circuit board from the outside thereof, for example, from another circuit board, under the condition of electro-magnetic shield, an electrical coaxial connector to be mounted on the specific circuit board is used.

Such an electrical coaxial connector comprises usually an insulating base, a signal-joining contacting conductor provided on the insulating base for transferring a signal and a grounding contacting conductor provided on the insulating base for surrounding the signal-joining contacting conductor to be supplied with a ground potential so as to put the signal supplied to the signal-joining contacting conductor in a condition of electro-magnetic shield. When the electrical coaxial connector is mounted on a circuit board to be put to practical use, the electrical coaxial connector is coupled with a mating coaxial connector which is, for example, another electrical coaxial connector mounted on another circuit board, so that the signal-joining contacting conductor comes into contact with a signal-joining conductor provided in the mating coaxial connector and the grounding contacting conductor comes into contact with a grounding conductor provided in the mating coaxial connector. With the electrical coaxial connector and the mating coaxial connector coupled with each other in such a manner, the signal supplied to the signal-joining contacting conductor of the electrical coaxial connector or to the signal-joining conductor of the mating coaxial connector is transferred to the signal joining conductor of the mating coaxial connector or to the signal joining contacting conductor of the electrical coaxial connector under the condition of electro-magnetic shield brought about by the grounding contacting conductor of the electrical coaxial connector and the grounding conductor of the mating coaxial connector. Thereby, the signal is transmitted between the circuit boards, on which the electrical coaxial connector and the mating coaxial connector are mounted respectively, under the condition of electro-magnetic shield.

When the electrical coaxial connector as mentioned above is mounted on the circuit board, the signal-joining contacting conductor is connected with a signal terminal provided on the circuit board and the ground-connecting contacting conductor is connected with a ground-potential terminal provided on the circuit board. Then, a condition wherein the signal-joining contacting conductor connected with the signal terminal provided on the circuit board and the ground-connecting contacting conductor connected with the ground-potential terminal provided on the circuit board are properly and surely connected respectively with the signal-joining conductor of the mating coaxial connector and the grounding conductor of the mating coaxial connector, is desired to be stably maintained for a relatively long period of time.

There has been proposed to provide an improved electrical coaxial connector which comprises an isolating base, a signal-joining contacting conductor provided on the insulating base and a grounding contacting conductor provided on the insulating base to surround the signal-joining contacting conductor and in which the signal-joining contacting conductor is so contrived in its structure that a condition wherein the signal-joining contacting conductor is connected with a signal-joining conductor of a mating coaxial connector is improved to be put in better maintenance, as disclosed in, for example, the Japanese patent application published before examination under publication number 2009-104836.

The previously proposed electrical coaxial connector disclosed in the publication mentioned above comprises a signal-joining contacting conductor (a socket type central conductor (22)) provided to be electrically connected with a signal-joining conductor (a pin type central conductor (12)) of a mating coaxial connector (a receptacle connector (11)), an insulating base (a second insulating housing (24)) mounted on a circuit board (a second board (2)) for supporting at its central portion the signal-joining contacting conductor, and a grounding contacting conductor (a second cylindrical conductor (23)) formed into a cylindrical shape for surrounding the insulating base supporting the signal-joining contacting conductor on the circuit board. The signal-joining contacting conductor has a top end portion made of a metallic tube and the signal joining conductor of the mating coaxial connector is inserted into the top end portion of the signal joining contacting conductor when the signal-joining contacting conductor is connected with the signal-joining conductor of the mating coaxial connector.

Further, four slits (27) are provided on the top end portion of the signal-joining contacting conductor in such a manner that each of the slits extends in parallel with an imaginary central axis of the metallic tube constituting the top end portion of the signal-joining contacting conductor. These four slits are arranged at regular intervals for surrounding the imaginary central axis of the metallic tube and an end portion of each of the slits reaches to a top end of the metallic tube in a direction along the imaginary central axis thereof. Accordingly, the top end portion of the signal-joining contacting conductor is divided into four parts by the four slits so as to be provided with four divided parts each extending in parallel with the imaginary central axis of the metallic tube.

On the top end portion of the signal joining contacting conductor constituted with the metallic tube and divided by the four slits to have the four divided parts, each of the four divided parts of the top end portion of the signal-joining contacting conductor is provided to be movable resiliently for coming close to or going away from the imaginary center axis of the metallic tube. Thereby, each of the four divided parts of the top end portion of the signal-joining contacting conductor comes into press-contact with the signal-joining conductor of the mating coaxial connector to exert resilient pressure on the same when the signal-joining conductor of the mating coaxial connector is inserted into the top end portion of the signal-joining contacting conductor. Consequently, it is expected that the condition wherein the signal-joining conductor of the mating coaxial connector is inserted into the top end portion of the signal-joining contacting conductor so that the signal joining contacting conductor is electrically connected with the signal joining conductor of the mating coaxial connector is able to be surely and stably maintained.

In the above-mentioned previously proposed electrical coaxial connector in which the signal joining contacting conductor has the top end portion constituted with the metallic tube into which the signal-joining conductor of the mating coaxial connector is inserted and provided with the four divided portions each extending in parallel with the imaginary central axis of the metallic tube, in order to maintain stably the condition wherein the signal joining conductor of the mating coaxial connector is inserted into the top end portion of the signal-joining contacting conductor so that the signal joining contacting conductor is electrically connected surely and properly with the signal-joining conductor of the mating coaxial connector, the four divided parts of the top end portion of the signal joining contacting conductor are required to exert relatively large resilient pressure to the signal-joining conductor of the mating coaxial connector. Then, each of the four divided parts of the top end portion of the signal-joining contacting conductor is required to have a relatively large length in the direction along the imaginary central axis of the metallic tube for increasing the resilient pressure exerted on the signal joining conductor of the mating coaxial connector by the four divided parts of the top end portion of the signal-joining contacting conductor. In the case where each of the four divided parts of the top end portion of the signal joining contacting conductor is not configured to have the relatively large length in the direction along the imaginary central axis of the metallic tube, the condition wherein the signal-joining conductor of the mating coaxial connector is inserted into the top end portion of the signal joining contacting conductor is not surely and stably maintained.

When each of the four divided parts of the top end portion of the signal-joining contacting conductor is configured to have the relatively large length in the direction along the imaginary central axis of the metallic tube, a portion of the signal-joining contacting conductor projecting from the insulating base is not able to be reduced in its length. As a result, it is difficult to reduce a measure of thickness of the electrical coaxial connector which comprises the signal-joining contacting conductor, the insulating base mounted on the circuit board for supporting the signal-joining contacting conductor and the grounding contacting conductor formed to surround the insulating base so that the electrical coaxial connector is prevented from making a relatively large projection on the circuit board. Therefore, although it has been desired for the electrical coaxial connector to be mounted on the circuit board to have a reduced measure of thickness, especially, in the field of relatively small-sized electronic apparatus in which a down-sized circuit board on which various kinds electronic parts are highly integrated is employed, such desire has not been sufficiently fulfilled.

BRIEF SUMMARY OF THE INVENTION

Accordingly, it is an object of the present invention to provide an electrical coaxial connector comprising a signal joining contacting conductor provided to be electrically connected with a signal-joining conductor of a mating coaxial connector, a grounding contacting conductor provided to be electrically connected with a grounding conductor of the mating coaxial connector and having a portion thereof placed around the signal-joining contacting conductor, and an insulating base member for supporting the signal-joining contacting conductor and the grounding contacting conductor to be isolated from each other, and which avoids the aforementioned problems and disadvantages encountered with the prior art.

Another object of the present invention is to provide an electrical coaxial connector comprising a signal-joining contacting conductor provided to be electrically connected with a signal-joining conductor of a mating coaxial connector, a grounding contacting conductor provided to be electrically connected with a grounding conductor of the mating coaxial connector and having a portion thereof placed around the signal-joining contacting conductor, and an insulating base member for supporting the signal-joining contacting conductor and the grounding contacting conductor to be isolated from each other, and in which a condition wherein the signal-joining contacting conductor is electrically connected surely and properly with the signal-joining conductor of the mating coaxial connector is able to be stably maintained with a simple structure.

A further object of the present invention is to provide an electrical coaxial connector comprising a signal-joining contacting conductor provided to be electrically connected with a signal-joining conductor of a mating coaxial connector, a grounding contacting conductor provided to be electrically connected with a grounding conductor of the mating coaxial connector and having a portion thereof placed around the signal joining contacting conductor, and an insulating base member for supporting the signal joining contacting conductor and the grounding contacting conductor to be isolated from each other, and with which a measure of thickness of the electrical coaxial connector is able to be effectively reduced with a simple structure.

According to the present invention, there is provided an electrical coaxial connector, which comprises a signal-joining contacting conductor having a body portion provided to be electrically connected with a signal-joining conductor of a mating coaxial connector and a signal-joining terminal portion extending from the body portion, a grounding contacting conductor having an annular portion placed around the body portion of the signal-joining contacting conductor to be electrically connected with a grounding conductor of the mating coaxial connector and a grounding terminal portion extending from the annular portion, and an insulating base member in which each of the signal-joining terminal portion of the signal-joining contacting conductor and the grounding terminal portion of the grounding contacting conductor is partially buried and which supports the signal-joining contacting conductor and the grounding contacting conductor to be isolated from each other, wherein the body portion of the signal joining contacting conductor is formed into a cylindrical shape and provided with a slit extending to surround an imaginary central axis of the cylindrical shape of the body portion, the body portion of the signal-joining contacting conductor is further provided with a base part and an engaging part which are opposite to each other with the slit between and connected with each other by a connecting part of the body portion at which the slit is not formed, the base part of the body portion is partially buried in the, and the engaging part of the body portion constitutes resilient annular part with at least one break for engaging resiliently with the signal-joining conductor of the mating connector.

When the electrical coaxial connector thus constituted in accordance with the present invention is put to practical use, for example, the insulating base member is mounted on a circuit board so that the signal joining terminal portion of the signal-joining contacting conductor is connected with a signal terminal provided on the circuit board and the grounding terminal portion of the grounding contacting conductor is connected with a grounding terminal provided on the circuit board. Then, the body portion formed into the cylindrical shape of the signal-joining contacting conductor having the signal joining terminal portion connected with the signal terminal provided on the circuit board is electrically connected with the signal-joining conductor of the mating coaxial connector and the annular portion of the of the grounding contacting conductor having the grounding terminal portion connected with the grounding terminal provided on the circuit board is electrically connected with the grounding conductor of the mating coaxial connector.

When the body portion formed into the cylindrical shape of the signal-joining contacting conductor is electrically connected with the signal joining conductor of the mating coaxial connector, the engaging part of the body portion separated by the slit provided on the body portion from the base part of the body portion buried partially in the insulating base member engages resiliently with the signal joining conductor of the mating coaxial connector to surround the same. On that occasion, since the engaging part of the body portion of the signal-joining contacting conductor is shaped to constitute the resilient annular part provided thereon with the break, the engaging part of the body portion is operative to clamp around the signal-joining conductor of the mating coaxial connector so as to exert resilient pressure to the same.

In the electrical coaxial connector according to the present invention, in order to maintain stably a condition wherein the body portion formed into the cylindrical shape of the signal-joining contacting conductor is electrically connected surely and properly with the signal-joining conductor of the mating coaxial connector, the engaging part of the body portion is required to exert relatively large resilient pressure to the signal joining conductor of the mating coaxial connector. Under such a situation, since the engaging part of the body portion is separated from the base part of the body portion by the slit provided on the body portion to surrounding the imaginary central axis of the cylindrical shape of the body portion so as to constitute the resilient annular part provided thereon with the break, it is possible for the engaging part of the body portion to exert the relatively large resilient pressure to the signal-joining conductor of the mating coaxial connector, for example, with adjustments of an inside diameter of the resilient annular part without increasing a measure of length of the body portion formed into the cylindrical shape in the direction of the imaginary central axis of the cylindrical shape of the body portion.

A measure of projection of the signal-joining contacting conductor on the circuit board is determined by the measure of length of the body portion formed into the cylindrical shape in the direction of the imaginary central axis of the cylindrical shape of the body portion of the signal joining contacting conductor and therefore a measure of thickness of the electrical coaxial connector is determined by the measure of length of the body portion of the signal-joining contacting conductor in the direction of the imaginary central axis of the cylindrical shape of the body portion.

Accordingly, with the electrical coaxial connector according to the present invention, since the engaging part of the body portion of the signal joining contacting conductor, which is able to exert the relatively large resilient pressure to the signal-joining conductor of the mating coaxial connector without increasing the measure of length of the body portion formed into the cylindrical shape in the direction of the imaginary central axis of the cylindrical shape of the body portion, is provided on the signal-joining contacting conductor, the condition wherein the body portion formed into the cylindrical shape of the signal-joining contacting conductor is electrically connected surely and properly with the signal-joining conductor of the mating coaxial connector is able to be stably maintained with a simple structure in which the measure of thickness of the electrical coaxial connector is able to be effectively reduced.

The above, and other objects, features and advantages of the present invention will become apparent from the following detailed description taken in conjunction with the accompanying drawings.

BRIEF DESCRIPTION OF THE SEVERAL VIEWS OF DRAWINGS

Figure 19:
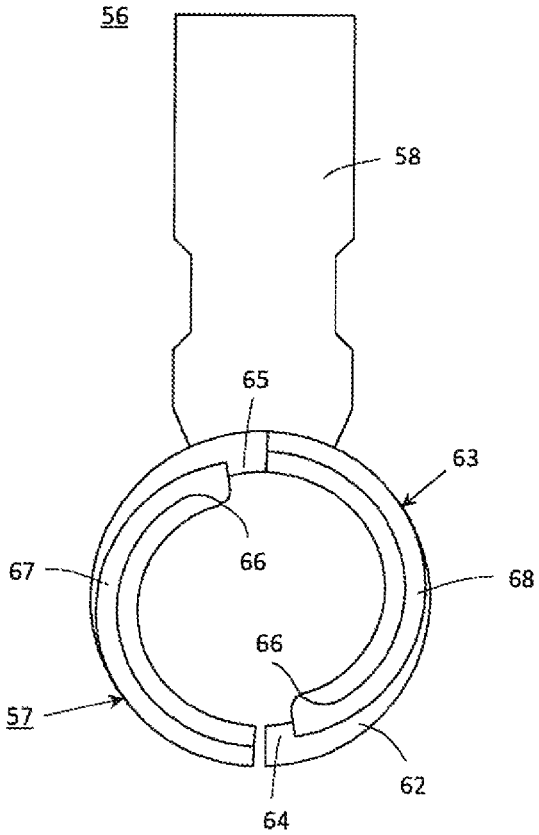
Figure 20:
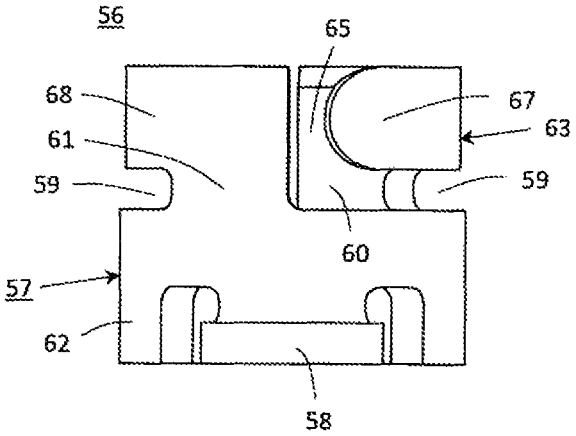

FIG. 19 is a schematic plan view showing the third example of signal-joining contacting conductor provided to be employed in the embodiment of electrical coaxial connector according to the present invention; and FIG. 20 is a schematic rear view showing the third example of signal-joining contacting conductor provided to be employed in the embodiment of electrical coaxial connector according to the present invention;

DETAILED DESCRIPTION OF THE INVENTION

Figure 1:
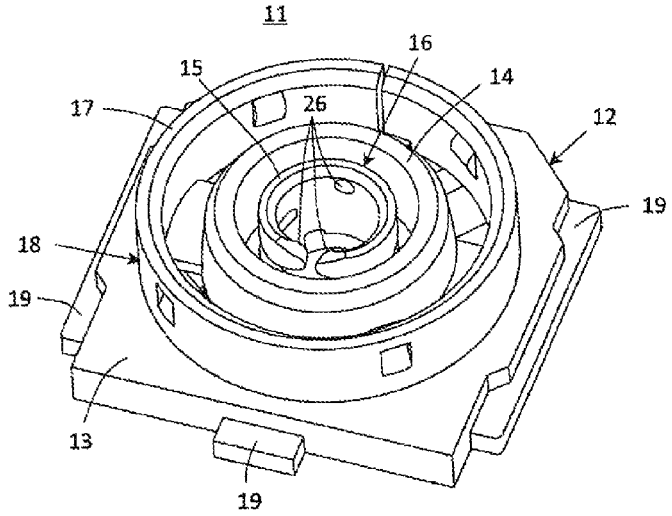
FIG. 1 is a schematic perspective view showing an embodiment of electrical coaxial connector according to the present invention.
Figure 2:
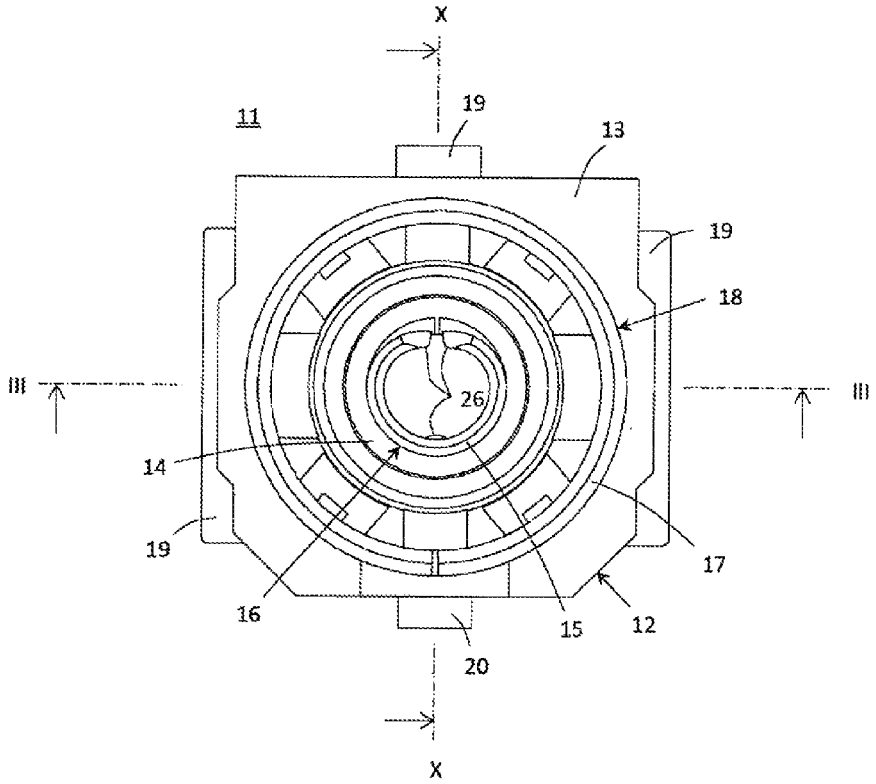
FIG. 2 is a schematic plan view showing the embodiment of electrical coaxial connector according to the present invention.

FIGS. 1 and 2 show an embodiment of electrical coaxial connector according to the present invention. Referring to FIGS. 1 and 2, an electrical coaxial connector 11, which constitutes the embodiment of electrical coaxial connector according to the present invention, is provided to be mounted on a circuit board and coupled with a mating coaxial connector which is another electrical coaxial connector for practical use. The electrical coaxial connector 11 has an insulating base member 12 made of insulator such as plastics or the like to be put on the circuit board on which the electrical coaxial connector 11 is mounted. The insulating base member 12 is provided with a flat board portion 13 and an annular projection 14 formed into a cylindrical shape at a central part of the flat board portion 13, as shown also in FIG. 3 showing a cross-section taken along line III-III in FIG. 2.

The electrical coaxial connector 11 comprises, in addition to the insulating base member 12, a signal joining contacting conductor 16 which is a first example of signal-joining contacting conductor employed in the electrical coaxial connector 11 and has a body portion 15 provided at the inside of the annular projection 14 of the insulating base member 12 to be electrically connected with a signal-joining conductor of the mating coaxial connector, and a grounding contacting conductor 18 which has an annular portion 17 provided around the annular projection 14 of the insulating base member 12 surrounding the body portion 15 of the signal-joining contacting conductor 16 to be electrically connected with a grounding conductor of the mating coaxial connector. The signal-joining contacting conductor 16 and the grounding contacting conductor 18 are supported by the insulating base member 12 to be isolated from each other.

Figure 3:
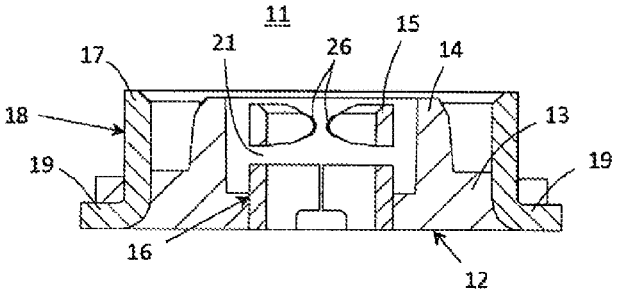
FIG. 3 is a schematic cross-sectional view showing a cross section taken along line III-III in FIG. 2.
Figure 4:
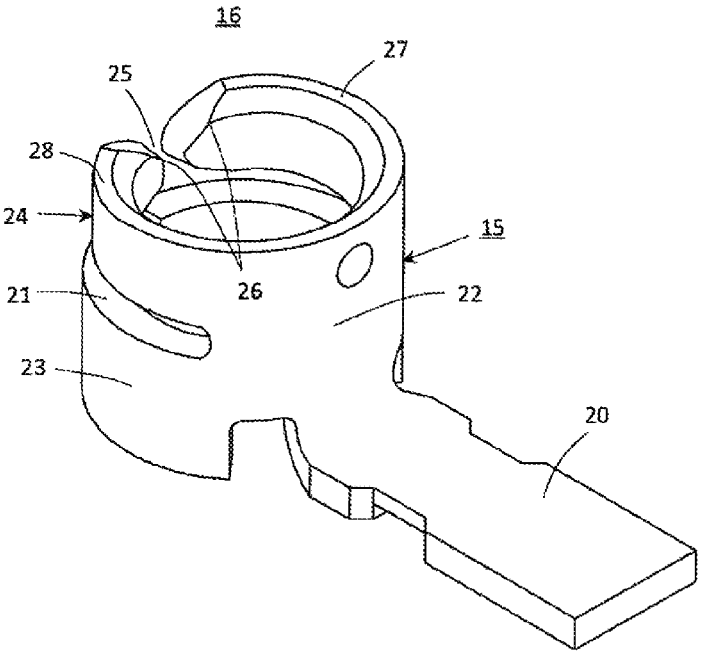
FIG. 4 is a schematic perspective view showing a first example of signal-joining contacting conductor provided to be employed in the embodiment of electrical coaxial connector according to the present invention.
Figure 5:
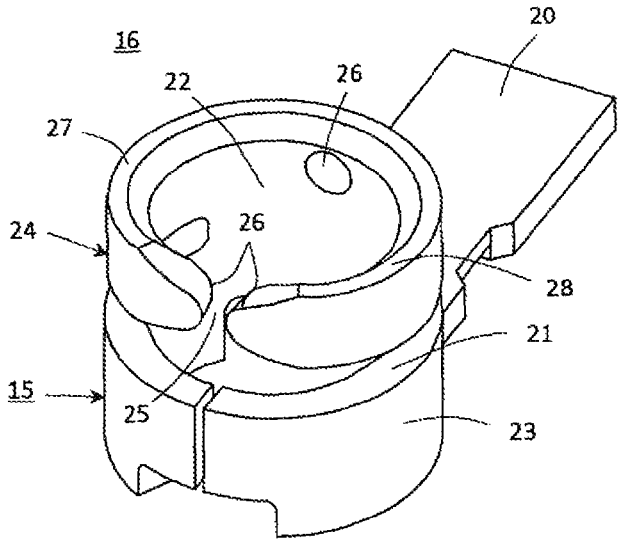
FIG. 5 is a schematic perspective view showing the first example of signal-joining contacting conductor provided to be employed in the embodiment of electrical coaxial connector according to the present invention.
Figure 6:
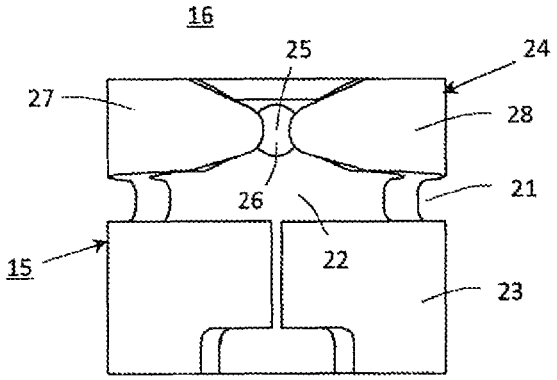
FIG. 6 is a schematic front view showing the first example of signal-joining contacting conductor provided to be employed in the embodiment of electrical coaxial connector according to the present invention.
Figure 7:
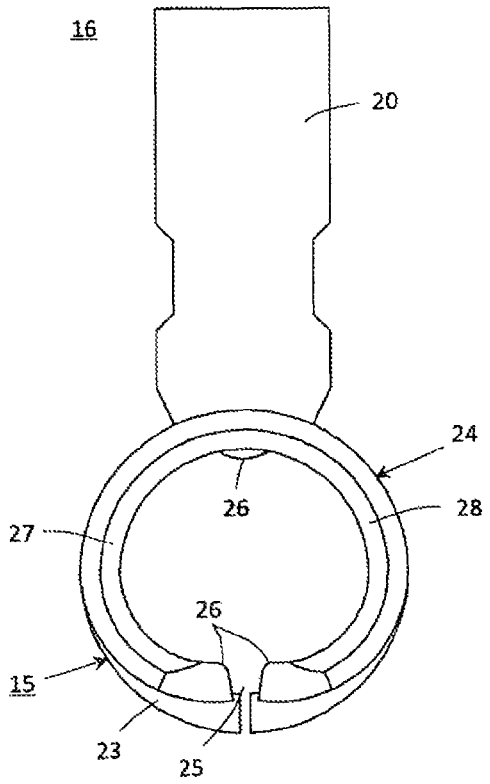
FIG. 7 is a schematic plan view showing the first example of signal-joining contacting conductor provided to be employed in the embodiment of electrical coaxial connector according to the present invention.
Figure 8:
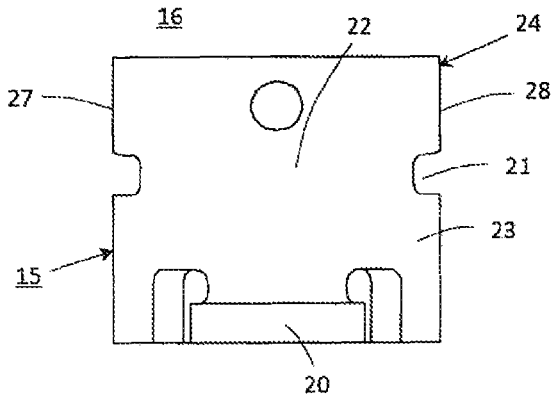
FIG. 8 is a schematic rear view showing the first example of signal-joining contacting conductor provided to be employed in the embodiment of electrical coaxial connector according to the present invention.

The grounding contacting conductor 18 is made of, for example, resilient conductive material such as a metal plate to have, in addition to the annular portion 17, a plurality of grounding terminal portions 19 each extending from an end of the annular portion 17 to the outside of the flat board portion 13 of the insulating base member 12, as shown in FIG. 3. The end of the annular portion 17 from which each of the grounding terminal portions 19 extends and a part of each of the grounding terminal portions 19 are buried in the flat board portion 13 of the insulating base member 12. Each of the grounding terminal portions 19 is provided to be connected with a grounding terminal provided on the circuit board on which the insulating base member 12 is put.

The signal-joining contacting conductor 16 is made of, for example, resilient conductive material such as a metal plate in the same manner as the grounding contacting conductor 18 to have, in addition to the body portion 15, a signal joining terminal portion 20 extending from an end of the body portion 15, as shown in FIGS. 4 to 8. The body portion 15 of the signal joining contacting conductor 16 is formed into a cylindrical shape and provided thereon with a slit 21 extending to surround an imaginary central axis of the cylindrical shape of the body portion 15. Therefore, the body portion 15 of the signal-joining contacting conductor 16 is further provided with a base part 23 and an engaging part 24 which are opposite to each other with the slit 21 between and connected with each other by a connecting part 22 of the body portion 15 at which the slit 21 is not formed.

The base part 23 of the body portion 15 of the signal-joining contacting conductor 16 includes the end of the body portion 15 from which the signal-joining terminal portion 20 of the signal joining contacting conductor 16 extends. That is, the signal-joining terminal portion 20 extends from the base part 23 of the body portion 15.

The engaging part 24 of the body portion 15 of the signal-joining contacting conductor 16 constitutes a resilient annular part with a break 25. The resilient annular part constituted with the engaging part 24 of the body portion 15 has a circular or an oval cross-section on a plane perpendicular to the imaginary central axis of the cylindrical shape of the body portion 15 and is provided on the inside surface thereof with a plurality of contact points 26 for coming into contact with the signal joining conductor of the mating coaxial connector.

The engaging part 24 of the body portion 15 of the signal-joining contacting conductor 16 has a first curved arm 27 and a second curved arm 28 extending respectively in opposite directions to surround the imaginary central axis of the cylindrical shape of the body portion 15. A free end of the first curved arm 27 and a free end of the second curved arm 28 are opposite to come close to each other, so that the break 25 on the resilient annular part constituted with the engaging part 24 is formed between the free end of the first curved arm 27 and the free end of the second curved arm 28.

The free end of the first curved arm 27 and the free end of the second curved arm 28 coming close to each other are positioned to be opposite to the connecting part 22 of the body portion 15 with the imaginary central axis of the cylindrical shape of the body portion 15 between. That is, the break 25 on the resilient annular part constituted with the engaging part 24 is positioned to be opposite to the connecting part 22 of the body portion 15 with the imaginary central axis of the cylindrical shape of the body portion 15 between.

In the structure in which the signal-joining contacting conductor 16 and the grounding contacting conductor 18 are supported by the insulating base member 12 to be isolated from each other as described above, each of the base part 23 of the body portion 15 of the signal joining contacting conductor 16 and the signal-joining terminal portion 20 extending from the base part 23 of the body portion 15 is partially buried in the flat board portion 13 of the insulating base member 12. An end of the signal-joining terminal portion 20 extends to the outside of the flat board portion 13 of the insulating base member 12 to be connected with the signal terminal provided on the circuit board on which the insulating base member 12 is put, as shown in FIG. 2. Further, the engaging part 24 of the body portion 15 of the signal-joining contacting conductor 16 projects from the flat board portion 13 of the insulating base member 12 at the inside of the annular projection 14 of the insulating base member 12 for engaging with the signal-joining conductor of the mating coaxial connector which in inserted into the resilient annular part constituted with the engaging part 24 so as to cause the contact points 26 provided on the inside surface of the resilient annular part constituted with the engaging part 24 to come into contact with the signal-joining conductor of the mating coaxial connector. Thereby, the signal-joining contacting conductor 16 is electrically connected with the signal-joining conductor of the mating coaxial connector.

When the electrical coaxial connector 11 is coupled with the mating coaxial connector, the electrical coaxial connector 11 is first so positioned that a ring-shaped end of the annular projection 14 of the insulating base member 12, a ring-shaped end of the body portion 15 of the signal joining contacting conductor 16 supported by the insulating base member 12, a ring-shaped end of the annular portion 17 of the grounding contacting conductor 18 supported by the insulating base member 12 are opposite to the mating coaxial connector and then caused to come close to the mating coaxial connector. The mating coaxial connector thus provided is shown as a mating coaxial connector 31 in FIG. 9 including a cross-section taken along line III-III in FIG. 2 and FIG. 10 including a cross-section taken along line X-X in FIG. 2.

Figure 9:
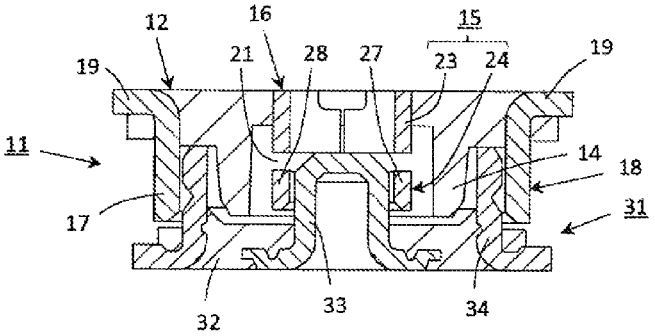
FIG. 9 is a schematic cross sectional view including a cross section taken along line III-III in FIG. 2 and showing the embodiment of electrical coaxial connector according to the present invention coupled with a mating coaxial connector.
Figure 10:
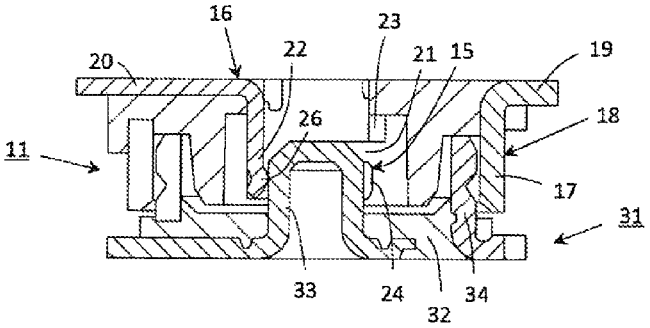
FIG. 10 is a schematic cross sectional view including a cross section taken along line X-X in FIG. 2 and showing the embodiment of electrical coaxial connector according to the present invention coupled with the mating coaxial connector.
Figure 11:
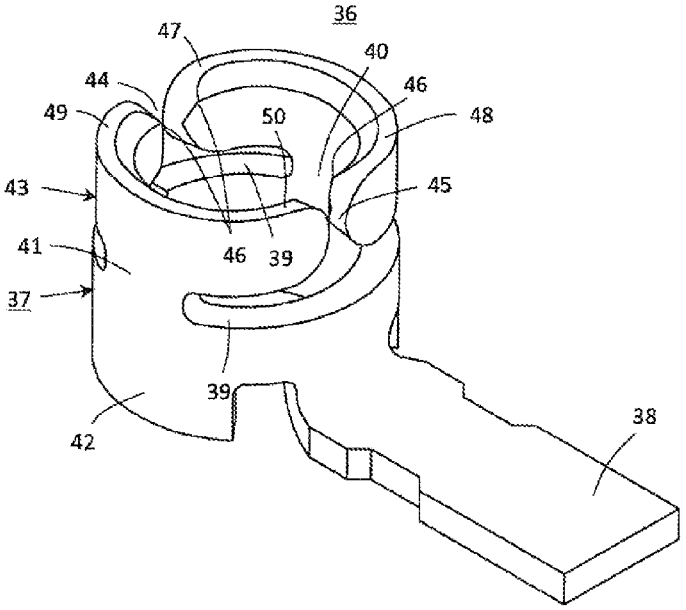
FIG. 11 is a schematic perspective view showing a second example of signal-joining contacting conductor provided to be employed in the embodiment of electrical coaxial connector according to the present invention.
Figure 12:
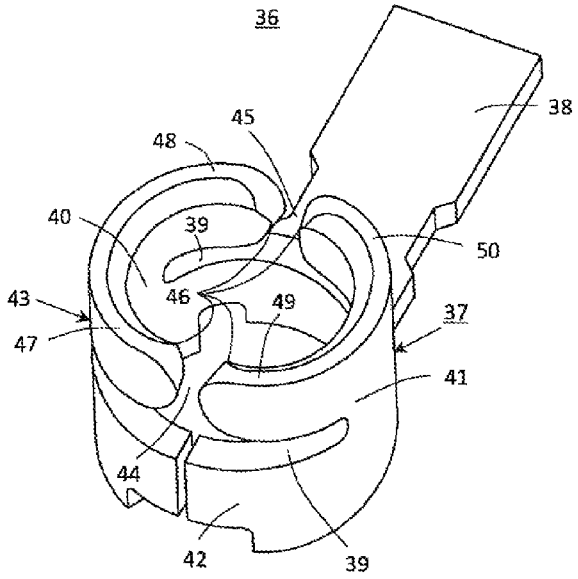
FIG. 12 is a schematic perspective view showing the second example of signal-joining contacting conductor provided to be employed in the embodiment of electrical coaxial connector according to the present invention.
Figure 13:
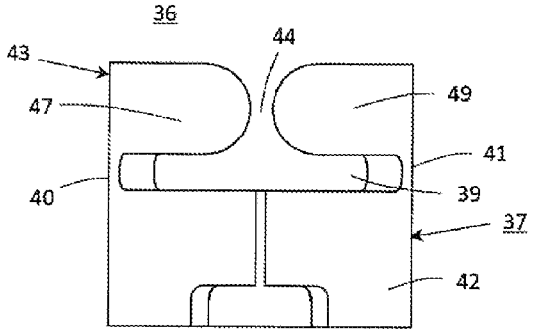
FIG. 13 is a schematic front view showing the second example of signal-joining contacting conductor provided to be employed in the embodiment of electrical coaxial connector according to the present invention.
Figure 14:
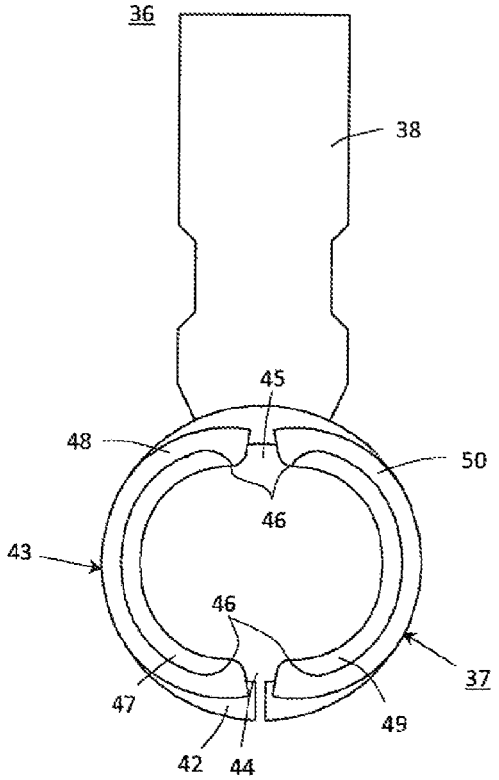
FIG. 14 is a schematic plan view showing the second example of signal-joining contacting conductor provided to be employed in the embodiment of electrical coaxial connector according to the present invention.
Figure 15:
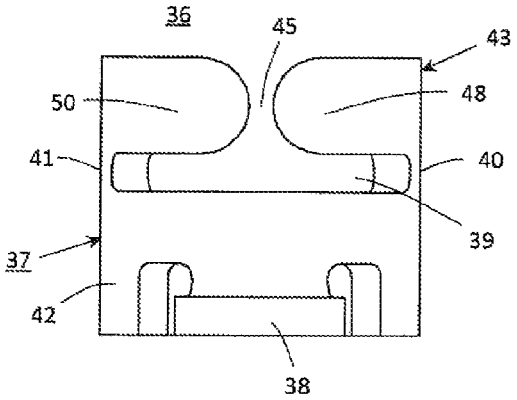
FIG. 15 is a schematic rear view showing the second example of signal-joining contacting conductor provided to be employed in the embodiment of electrical coaxial connector according to the present invention.
Figure 16:
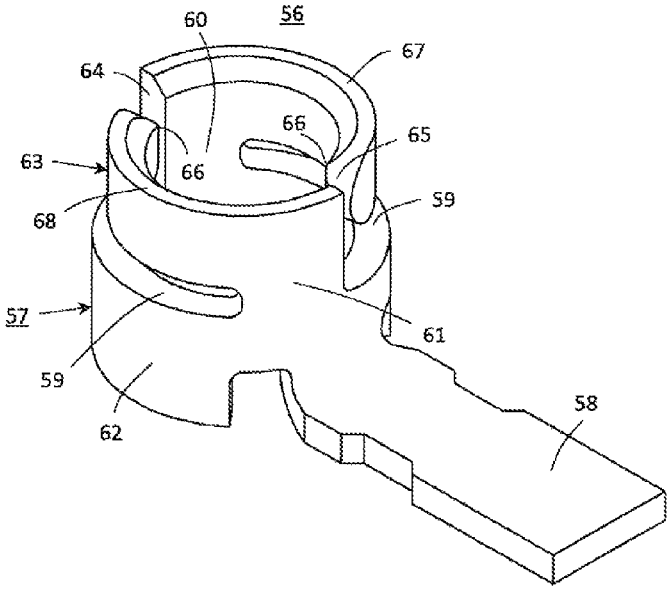
FIG. 16 is a schematic perspective view showing a third example of signal joining contacting conductor provided to be employed in the embodiment of electrical coaxial connector according to the present invention.
Figure 17:
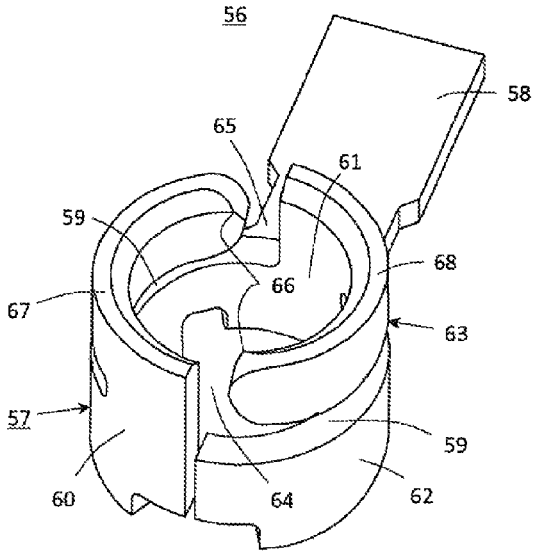
FIG. 17 is a schematic perspective view showing the third example of signal-joining contacting conductor provided to be employed in the embodiment of electrical coaxial connector according to the present invention.
Figure 18:
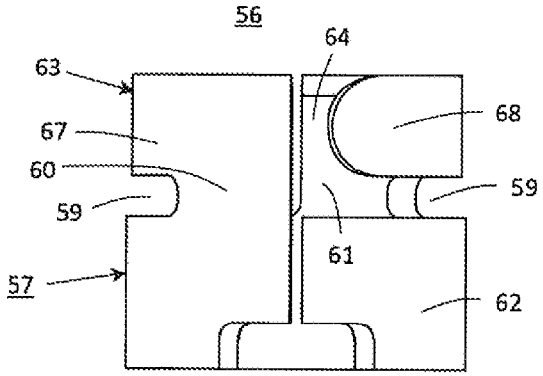
FIG. 18 is a schematic front view showing the third example of signal-joining contacting conductor provided to be employed in the embodiment of electrical coaxial connector according to the present invention.

The mating coaxial connector 31 shown in FIGS. 9 and 10 comprises an insulating base member 32 made of insulator such as plastics or the like to be put on a circuit board on which the mating coaxial connector 31 is mounted, a signal-joining conductor 33 formed into a cylindrical shape for standing at a central portion of the insulating base member 32 and a grounding conductor 34 formed in to an annular shape to be supported by the insulating base member 32 for surrounding the signal-joining conductor 33. The signal joining conductor 33 is connected with a signal terminal provided on the circuit board on which the insulating base member 32 is put and the grounding conductor 34 is connected with a grounding terminal provided on the circuit board on which the insulating base member 32 is put.

Under a condition wherein the electrical coaxial connector 11 and the mating coaxial connector 31 are put in mutual coupling, the engaging part 24 of the body portion 15 of the signal joining contacting conductor 16 constituting the resilient annular part in the electrical coaxial connector 11 engages with the signal joining conductor 33 of the mating coaxial connector 31 which is inserted into the resilient annular part constituted with the engaging part 24, and the annular portion 17 of the grounding contacting conductor 18 in the electrical coaxial connector 11 engages with the grounding conductor 34 of the mating coaxial connector 31, as shown in FIGS. 9 and 10. When the engaging part 24 of the body portion 15 of the signal-joining contacting conductor 16 constituting the resilient annular part is put in engagement with the signal-joining conductor 33 of the mating coaxial connector 31, the contact points 26 provided on the inside surface of the resilient annular part constituted with the engaging part 24 are caused to come into contact with the signal-joining conductor 33 of the mating coaxial connector 31 and the first and second curved arms 27 and 28 of the engaging part 24 of the body portion 15 of the signal-joining contacting conductor 16 constituting the resilient annular part provided thereon with the break 25 are operative to exert relatively large resilient pressure around the signal joining conductor 33 of the mating coaxial connector 31. Thereby, the signal-joining contacting conductor 16 of the electrical coaxial connector 11 is electrically connected with the signal-joining conductor 33 of the mating coaxial connector 31 with the relatively large resilient pressure exerted around the signal-joining conductor 33 of the mating coaxial connector 31, so that a condition wherein the signal joining contacting conductor 16 of the electrical coaxial connector 11 is electrically connected surely and properly with the signal-joining conductor 33 of the mating coaxial connector 31 is stably maintained.

FIGS. 11 to 15 show a signal joining contacting conductor 36 which is a second example of signal-joining contacting conductor employed in the electrical coaxial connector 11 and able to be employed in place of the signal-joining contacting conductor 16 described above in the electrical coaxial connector 11.

The signal joining contacting conductor 36 shown in FIGS. 11 to 15 is made of, for example, resilient conductive material such as a metal plate to have a body portion 37 corresponding to the body portion 15 of the signal-joining contacting conductor 16 described above and a signal-joining terminal portion 38 extending from an end of the body portion 37. The body portion 37 of the signal-joining contacting conductor 36 is formed into a cylindrical shape and provided thereon with a couple of slits 39 extending to surround an imaginary central axis of the cylindrical shape of the body portion 37. Therefore, the body portion 37 of the signal-joining contacting conductor 36 is further provided with a base part 42 and an engaging part 43 which are opposite to each other with the slits 39 between and connected with each other by a first connecting part 40 of the body portion 37 and a second connecting part 41 of the body portion 37, at each of which the slit 39 is not formed. In the body portion 37 of the signal-joining contacting conductor 36, the first connecting part 40 and the second connecting part 41 are opposite to each other with the imaginary central axis of the cylindrical shape of the body portion 37 between.

The base part 42 of the body portion 37 of the signal-joining contacting conductor 36 includes the end of the body portion 37 from which the signal-joining terminal portion 38 of the signal joining contacting conductor 36 extends. That is, the signal-joining terminal portion 38 extends from the base part 42 of the body portion 37.

The engaging part 43 of the body portion 37 of the signal-joining contacting conductor 36 constitutes a resilient annular part provided thereon with a first break 44 and a second break 45. The resilient annular part constituted with the engaging part 43 of the body portion 37 has a circular or an oval cross-section on a plane perpendicular to the imaginary central axis of the cylindrical shape of the body portion 37 and is provided on the inside surface thereof with a plurality of contact points 46 for coming into contact with the signal-joining conductor 33 of the mating coaxial connector.

The engaging part 43 of the body portion 37 of the signal-joining contacting conductor 36 has a first curved arm 47 and a second curved arm 48 extending from the first connecting part 40 respectively in opposite directions to surround the imaginary central axis of the cylindrical shape of the body portion 37 and a third curved arm 49 and a fourth curved arm 50 extending from the second connecting part 41 respectively in opposite directions to surround the imaginary central axis of the cylindrical shape of the body portion 37. A free end of the first curved arm 47 and a free end of the third curved arm 49 are opposite to come close to each other, so that the first break 44 on the resilient annular part constituted with the engaging part 43 is formed between the free end of the first curved arm 47 and the free end of the third curved arm 49. Further, a free end of the second curved arm 48 and a free end of the fourth curved arm 50 are opposite to come close to each other, so that the second break 45 on the resilient annular part constituted with the engaging part 43 is formed between the free end of the second curved arm 48 and the free end of the fourth curved arm 50.

The free end of the first curved arm 47 and the free end of the third curved arm 49 coming close to each other are positioned to be opposite to the free end of the second curved aim 48 and the free end of the fourth curved arm 50 coming close to each other with the imaginary central axis of the cylindrical shape of the body portion 37 between. That is, the first break 44 on the resilient annular part constituted with the engaging part 43 is positioned to be opposite to the second break 45 on the resilient annular part constituted with the engaging part 43 with the imaginary central axis of the cylindrical shape of the body portion 37 between.

In a structure in which the signal-joining contacting conductor 36 thus constituted is supported, in place of the signal-joining contacting conductor 16, along with the grounding contacting conductor 18 by the insulating base member 12, each of the base part 42 of the body portion 37 of the signal joining contacting conductor 36 and the signal joining terminal portion 38 extending from the base part 42 of the body portion 37 is partially buried in the flat board portion 13 of the insulating base member 12. An end of the signal joining terminal portion 38 extends to the outside of the flat board portion 13 of the insulating base member 12 to be connected with the signal terminal provided on the circuit board on which the insulating base member 12 is put. Further, the engaging part 43 of the body portion 37 of the signal-joining contacting conductor 36 projects from the flat board portion 13 of the insulating base member 12 at the inside of the annular projection 14 of the insulating base member 12 for engaging with the signal-joining conductor of the mating coaxial connector which in inserted into the resilient annular part constituted with the engaging part 43 so as to cause the contact points 46 provided on the inside surface of the resilient annular part constituted with the engaging part 43 to come into contact with the signal joining conductor of the mating coaxial connector. Thereby, the signal-joining contacting conductor 36 is electrically connected with the signal-joining conductor of the mating coaxial connector.

Under a condition wherein the electrical coaxial connector 11 in which the signal-joining contacting conductor 36 is employed in place of the signal-joining contacting conductor 16 is put in coupling with the mating coaxial connector, the engaging part 43 of the body portion 37 of the signal joining contacting conductor 36 constituting the resilient annular part in the electrical coaxial connector 11 engages with the signal-joining conductor of the mating coaxial connector which is inserted into the resilient annular part constituted with the engaging part 43, and the annular portion 17 of the grounding contacting conductor 18 in the electrical coaxial connector 11 engages with the grounding conductor of the mating coaxial connector. When the engaging part 43 of the body portion 37 of the signal-joining contacting conductor 36 constituting the resilient annular part is put in engagement with the signal-joining conductor of the mating coaxial connector, the contact points 46 provided on the inside surface of the resilient annular part constituted with the engaging part 43 are caused to come into contact with the signal-joining conductor of the mating coaxial connector and the first to fourth curved arms 47 to 50 of the engaging part 43 of the body portion 37 of the signal-joining contacting conductor 36 constituting the resilient annular part provided thereon with the first and second breaks 44 and 45 are operative to exert relatively large resilient pressure around the signal-joining conductor of the mating coaxial connector. Thereby, the signal-joining contacting conductor 36 of the electrical coaxial connector 11 is electrically connected with the signal-joining conductor of the mating coaxial connector with the relatively large resilient pressure exerted around the signal-joining conductor of the mating coaxial connector, so that a condition wherein the signal joining contacting conductor 36 of the electrical coaxial connector 11 is electrically connected surely and properly with the signal joining conductor of the mating coaxial connector is stably maintained.

FIGS. 16 to 20 show a signal-joining contacting conductor 56 which is a third example of signal-joining contacting conductor employed in the electrical coaxial connector 11 and able to be employed in place of the signal-joining contacting conductor 16 described above in the electrical coaxial connector 11.

The signal joining contacting conductor 56 shown in FIGS. 16 to 20 is made of, for example, resilient conductive material such as a metal plate to have a body portion 57 corresponding to the body portion 15 of the signal-joining contacting conductor 16 described above and a signal-joining terminal portion 58 extending from an end of the body portion 57. The body portion 57 of the signal-joining contacting conductor 56 is formed into a cylindrical shape and provided thereon with a couple of slits 59 extending to surround an imaginary central axis of the cylindrical shape of the body portion 57. Therefore, the body portion 57 of the signal-joining contacting conductor 56 is further provided with a base part 62 and an engaging part 63 which are opposite to each other with the slits 59 between and connected with each other by a first connecting part 60 of the body portion 57 and a second connecting part 61 of the body portion 57, at each of which the slit 59 is not formed. In the body portion 57 of the signal-joining contacting conductor 56, the first connecting part 60 and the second connecting part 61 are opposite to each other with the imaginary central axis of the cylindrical shape of the body portion 57 between.

The base part 62 of the body portion 57 of the signal-joining contacting conductor 56 includes the end of the body portion 57 from which the signal-joining terminal portion 58 of the signal joining contacting conductor 56 extends. That is, the signal-joining terminal portion 58 extends from the base part 62 of the body portion 57.

The engaging part 63 of the body portion 57 of the signal-joining contacting conductor 56 constitutes a resilient annular part provided thereon with a first break 64 and a second break 65. The resilient annular part constituted with the engaging part 63 of the body portion 57 has a circular or an oval cross-section on a plane perpendicular to the imaginary central axis of the cylindrical shape of the body portion 57 and is provided on the inside surface thereof with a plurality of contact points 66 for coming into contact with the signal-joining conductor of the mating coaxial connector.

The engaging part 63 of the body portion 57 of the signal-joining contacting conductor 56 has a first curved arm 67 extending from the first connecting part 60 to surround the imaginary central axis of the cylindrical shape of the body portion 57 and a second curved arm 68 extending from the second connecting part 61 to surround the imaginary central axis of the cylindrical shape of the body portion 57. A free end of the first curved arm 67 is opposite to the second connecting part 61 for coming close to the same, so that the second break 65 on the resilient annular part constituted with the engaging part 63 is formed between the free end of the first curved arm 67 and the second connecting part 61, and a free end of the second curved arm 68 is opposite to the first connecting part 60 for coming close to the same, so that the first break 64 on the resilient annular part constituted with the engaging part 63 is formed between the free end of the second curved arm 68 and the first connecting part 60.

The free end of the first curved arm 67 and the free end of the second curved arm 68 are positioned to be opposite to each other with the imaginary central axis of the cylindrical shape of the body portion 57 between. That is, the first break 64 and the second break 65 on the resilient annular part constituted with the engaging part 63 of the body portion 57 are positioned to be opposite to each other with the imaginary central axis of the cylindrical shape of the body portion 57 between.

In a structure in which the signal-joining contacting conductor 56 thus constituted is supported, in place of the signal-joining contacting conductor 16, along with the grounding contacting conductor 18 by the insulating base member 12, each of the base part 62 of the body portion 57 of the signal joining contacting conductor 56 and the signal joining terminal portion 58 extending from the base part 62 of the body portion 57 is partially buried in the flat board portion 13 of the insulating base member 12. An end of the signal joining terminal portion 58 extends to the outside of the flat board portion 13 of the insulating base member 12 to be connected with the signal terminal provided on the circuit board on which the insulating base member 12 is put. Further, the engaging part 63 of the body portion 57 of the signal-joining contacting conductor 56 projects from the flat board portion 13 of the insulating base member 12 at the inside of the annular projection 14 of the insulating base member 12 for engaging with the signal-joining conductor of the mating coaxial connector which in inserted into the resilient annular part constituted with the engaging part 63 so as to cause the contact points 66 provided on the inside surface of the resilient annular part constituted with the engaging part 63 to come into contact with the signal joining conductor of the mating coaxial connector. Thereby, the signal-joining contacting conductor 56 is electrically connected with the signal-joining conductor of the mating coaxial connector.

Under a condition wherein the electrical coaxial connector 11 in which the signal-joining contacting conductor 56 is employed in place of the signal-joining contacting conductor 16 is put in coupling with the mating coaxial connector, the engaging part 63 of the body portion 57 of the signal joining contacting conductor 56 constituting the resilient annular part in the electrical coaxial connector 11 engages with the signal-joining conductor of the mating coaxial connector which is inserted into the resilient annular part constituted with the engaging part 63, and the annular portion 17 of the grounding contacting conductor 18 in the electrical coaxial connector 11 engages with the grounding conductor of the mating coaxial connector. When the engaging part 63 of the body portion 57 of the signal-joining contacting conductor 56 constituting the resilient annular part is put in engagement with the signal-joining conductor of the mating coaxial connector, the contact points 66 provided on the inside surface of the resilient annular part constituted with the engaging part 63 are caused to come into contact with the signal joining conductor of the mating coaxial connector and the first and second curved arms 67 and 68 of the engaging part 63 of the body portion 57 of the signal-joining contacting conductor 56 constituting the resilient annular part provided thereon with the first and second breaks 64 and 65 are operative to exert relatively large resilient pressure around the signal-joining conductor of the mating coaxial connector. Thereby, the signal-joining contacting conductor 56 of the electrical coaxial connector 11 is electrically connected with the signal-joining conductor of the mating coaxial connector with the relatively large resilient pressure exerted around the signal-joining conductor of the mating coaxial connector, so that a condition wherein the signal joining contacting conductor 56 of the electrical coaxial connector 11 is electrically connected surely and properly with the signal joining conductor of the mating coaxial connector is stably maintained.

In the electrical coaxial connector 11 thus constituted in accordance with the present invention, in order to maintain stably a condition wherein the body portion 15, 37 or 57 formed into the cylindrical shape of the signal joining contacting conductor 16, 36 or 56 is electrically connected surely and properly with the signal-joining conductor of the mating coaxial connector, the engaging part 24, 43 or 63 of the body portion 15, 37 or 57 is required to exert relatively large resilient pressure to the signal-joining conductor of the mating coaxial connector. Under such a situation, since the engaging part 24, 43 or 63 of the body portion 15, 37 or 57 is separated from the base part 23, 42 or 62 of the body portion 15, 37 or 57 by the slit 21, the slits 39 or the slits 59 provided on the body portion 15, 37 or 57 to surrounding the imaginary central axis of the cylindrical shape of the body portion 15, 37 or 57 so as to constitute the resilient annular part provided thereon with the break 25, the first and second breaks 44 and 45 or the first and second breaks 64 and 65, it is possible for the engaging part 24, 43 or 63 of the body portion 15, 37 or 57 to exert the relatively large resilient pressure to the signal-joining conductor of the mating coaxial connector, for example, with adjustments of an inside diameter of the resilient annular part without increasing a measure of length of the body portion 15, 37 or 57 formed into the cylindrical shape in the direction of the imaginary central axis of the cylindrical shape of the body portion 15, 37 or 57.

A measure of projection of the signal joining contacting conductor 16, 36 or 56 on the circuit board is determined by the measure of length of the body portion 15, 37 or 57 formed into the cylindrical shape in the direction of the imaginary central axis of the cylindrical shape of the body portion 15, 37 or 57 of the signal joining contacting conductor 16, 36 or 56 and therefore a measure of thickness of the electrical coaxial connector 11 is determined by the measure of length of the body portion 15, 37 or 57 of the signal joining contacting conductor 16, 36 or 56 in the direction of the imaginary central axis of the cylindrical shape of the body portion 15, 37 or 57.

Accordingly, with the electrical coaxial connector 11, since the engaging part 24, 43 or 63 of the body portion 15, 37 or 57 of the signal-joining contacting conductor 16, 36 or 56, which is able to exert the relatively large resilient pressure to the signal-joining conductor of the mating coaxial connector without increasing the measure of length of the body portion 15, 37 or 57 formed into the cylindrical shape in the direction of the imaginary central axis of the cylindrical shape of the body portion 15, 37 or 57, is provided on the signal joining contacting conductor 16, 36 or 56, the condition wherein the body portion 15, 37 or 57 formed into the cylindrical shape of the signal-joining contacting conductor 16, 36 or 56 is electrically connected surely and properly with the signal-joining conductor of the mating coaxial connector is able to be stably maintained with a simple structure in which the measure of thickness of the electrical coaxial connector 11 is able to be effectively reduced.

The invention claimed is:

1. An electrical coaxial connector comprising;

a signal-joining contacting conductor having a body portion provided to be electrically connected with a signal-joining conductor of a mating coaxial connector and a signal-joining terminal portion extending from the body portion, a grounding contacting conductor having an annular portion placed around the body portion of the signal joining contacting conductor to be electrically connected with a grounding conductor of the mating coaxial connector and a grounding terminal portion extending from the annular portion, and an insulating base member in which each of the signal-joining terminal portion of the signal-joining contacting conductor and the grounding terminal portion of the grounding contacting conductor is partially buried and which supports the signal joining contacting conductor and the grounding contacting conductor to be isolated from each other, wherein the body portion of the signal-joining contacting conductor is formed into a cylindrical shape and provided with a slit extending to surround an imaginary central axis of the cylindrical shape of the body portion, wherein the body portion of the signal joining contacting conductor is further provided with a base part and an engaging part which are opposite to each other with the slit between the base part and the engaging part and connected with each other by a connecting part of the body portion at which the slit is not formed, wherein the base part of the body portion is partially buried in the insulating base member, and wherein the engaging part of the body portion constitutes a resilient annular part with at least one break for engaging resiliently with the signal joining conductor of the mating connector.

2. An electrical coaxial connector according to claim 1, wherein the signal-joining terminal portion of the signal-joining contacting conductor is configured to extend from the base part of the body portion of the signal joining contacting conductor.

3. An electrical coaxial connector according to claim 1, wherein the resilient annular part constituted with the engaging part of the body portion of the signal-joining contacting conductor has an oval cross-section on a plane perpendicular to the imaginary central axis of the cylindrical shape of the body portion.

4. An electrical coaxial connector according to claim 1, wherein the resilient annular part constituted with the engaging part of the body portion of the signal-joining contacting conductor is provided on the inside surface thereof with a plurality of contact points for coming into contact with the signal-joining conductor of the mating coaxial connector.

5. An electrical coaxial connector according to claim 1, wherein the engaging part of the body portion of the signal-joining contacting conductor has first and second curved arms extending respectively in opposite directions to surround the imaginary central axis of the cylindrical shape of the body portion, and a free end of the first curved arm and a free end of the second curved arm are opposite to come close to each other, so that the break on the resilient annular part constituted with the engaging part is formed between the free end of the first curved arm and the free end of the second curved arm.

6. An electrical coaxial connector according to claim 5, wherein the free end of the first curved arm and the free end of the second curved arm coming close to each other are positioned to be opposite to the connecting part of the body portion with the imaginary central axis of the cylindrical shape of the body portion between each of the free ends of the first and second curved arms and the connecting part of the body portion.

7. An electrical coaxial connector according to claim 1, wherein the connecting part of the body portion of the signal-joining contacting conductor is configured to have first and second connecting parts separated from each other in a direction surrounding the imaginary central axis of the cylindrical shape of the body portion; the engaging part of the body portion is configured to have first and second curved arms extending from the first connecting part respectively in opposite directions to surround the imaginary central axis of the cylindrical shape of the body portion and third and fourth curved arms extending from the second connecting part respectively in opposite directions to surround the imaginary central axis of the cylindrical shape of the body portion; a free end of the first curved arm and a free end of the third curved arm are opposite to come close to each other, so that the break on the resilient annular part constituted with the engaging part is formed between the free end of the first curved arm and the free end of the third curved arm; and a free end of the second curved arm and a free end of the fourth curved arm are opposite to come close to each other, so that the break on the resilient annular part constituted with the engaging part is formed between the free end of the second curved arm and the free end of the fourth curved arm.

8. An electrical coaxial connector according to claim 7, wherein the first and second connecting parts are positioned to be opposite to each other with the imaginary central axis of the cylindrical shape of the body portion between the first and second connecting parts.

9. An electrical coaxial connector according to claim 8, wherein the free ends of the first and third curved arms coming close to each other and the free ends of the second and fourth curved arms coming close to each other are positioned to be opposite to each other with the imaginary central axis of the cylindrical shape of the body portion between each of the free ends of the first and third curved arms and each of the free ends of the second and fourth curved arms.

10. An electrical coaxial connector according to claim 1, wherein the connecting part of the body portion of the signal-joining contacting conductor is configured to have first and second connecting parts separated from each other in a direction surrounding the imaginary central axis of the cylindrical shape of the body portion; the engaging part of the body portion is configured to have a first curved arm extending from the first connecting part to surround the imaginary central axis of the cylindrical shape of the body portion and a second curved arm extending from the second connecting part to surround the imaginary central axis of the cylindrical shape of the body portion; a free end of the first curved arm is opposite to the second connecting part for coming close to the second connecting part, so that the break on the resilient annular part constituted with the engaging part is formed between the free end of the first curved arm and the second connecting part; and a free end of the second curved arm is opposite to the first connecting part for coming close to the first connecting part, so that the break on the resilient annular part constituted with the engaging part is formed between the free end of the second curved arm and the first connecting part.

11. An electrical coaxial connector according to claim 10, wherein the first and second connecting parts are positioned to be opposite to each other with the imaginary central axis of the cylindrical shape of the body portion between the first and second connecting parts.

12. An electrical coaxial connector according to claim 11, wherein the free ends of the first and second curved arms are positioned to be opposite to each other with the imaginary central axis of the cylindrical shape of the body portion between the free ends of the first and second curved arms.

* * * * *